United States Patent [19]

Meyer

[11] Patent Number: 4,501,466

[45] Date of Patent: Feb. 26, 1985

[54] HIGH CURRENT CONTACT

[75] Inventor: Jeffry R. Meyer, Penn Hills Township, Allegheny County, Pa.

[73] Assignee: Westinghouse Electric Corp., Pittsburgh, Pa.

[21] Appl. No.: 447,058

[22] Filed: Dec. 6, 1982

Related U.S. Application Data

[63] Continuation of Ser. No. 288,609, Jul. 30, 1981, abandoned, which is a continuation of Ser. No. 801,122, May 27, 1977, abandoned.

[51] Int. Cl.[3] ..... H01R 13/12

[52] U.S. Cl. ..... 339/255 P; 339/262 R

[58] Field of Search ..... 339/255, 262

[56] References Cited

U.S. PATENT DOCUMENTS

| | | | |
|---|---|---|---|
| 2,123,631 | 7/1938 | Kolhler . | |
| 2,243,567 | 5/1941 | Linde . | |
| 2,265,006 | 12/1941 | Rubel et al. . | |
| 2,770,788 | 11/1956 | Eschner, Jr. | 339/255 R |
| 3,264,439 | 8/1966 | Ernsting | 200/148 |
| 3,424,884 | 1/1969 | Floessel et al. | 200/148 |
| 3,526,736 | 9/1970 | Ramrath . | |
| 3,560,688 | 2/1971 | Bachler | 200/166 |
| 3,594,697 | 7/1971 | Azbell | 339/255 P |
| 3,713,075 | 1/1973 | Clark | 339/64 R |
| 3,963,298 | 6/1976 | Seiler | 339/95 R |
| 3,982,806 | 9/1976 | Wilson et al. | 339/64 R |
| 4,015,095 | 3/1977 | Betsch et al. | 200/148 A |

FOREIGN PATENT DOCUMENTS

| | | | |
|---|---|---|---|
| 1002845 | 8/1957 | Fed. Rep. of Germany . | |
| 972235 | 6/1959 | Fed. Rep. of Germany . | |
| 1137789 | 10/1962 | Fed. Rep. of Germany . | |
| 1179288 | 5/1963 | Fed. Rep. of Germany . | |
| 2265022 | 3/1976 | Fed. Rep. of Germany . | |
| 2266328 | 10/1975 | France . | |
| 588600 | 2/1959 | Italy | 339/255 R |
| 51-32824 | 9/1976 | Japan . | |
| 415499 | 8/1934 | United Kingdom | 339/255 R |
| 506922 | 5/1976 | U.S.S.R. | 339/255 R |

*Primary Examiner*—Joseph H. McGlynn
*Attorney, Agent, or Firm*—M. S. Yatsko

[57] ABSTRACT

A telescoping contact assembly for high current applications includes a center conductor and a coaxial contact sheath assembly. The contact sheath assembly comprises a plurality of spring-loaded elongated contact fingers arranged about the inner circumference of a cylindrical housing. Each spring is loaded so as to create a spring force directed along the length of each contact finger in an axial direction with respect to the housing. Each contact finger is urged against a surface of the housing at a point of contact offset from the line of action of the spring force, thereby producing a radial force component creating contact pressure between each finger contact and the housing, and between each finger contact and the inserted center conductor.

9 Claims, 5 Drawing Figures

14

14

HIGH CURRENT CONTACT

This is a continuation of application Ser. No. 288,609, filed July 30, 1981, abandoned, which is a continuation of Ser. No. 801,122, filed May 27, 1977, abandoned.

BACKGROUND OF THE INVENTION

1. Field of the Invention

The invention relates generally to electrical apparatus, and more particularly to high-current sliding contact assemblies.

2. Description of the Prior Art

Many devices used in the transmission and distribution of electrical energy require sliding contact current transfer members. Such devices include gas insulated or air type disconnect switches, grounding switches, high-current bus switches, and gas insulated transmission bus joints. Each of these devices includes two members relatively movable between an open position wherein the members are physically separated and a closed position wherein the members are in mechanical engagement, allowing electrical energy to flow therebetween.

The problem to be solved in all of these devices is that of reducing electrical resistance at the point of mechanical engagement. This resistance produces a joule heating effect as current passes therethrough, thereby limiting the maximum amount of current which can be safely transferred. Methods for reducing this resistance include providing a large number of separate points of engagement between the separable members and providing contact pressure urging the two members together. While increasing the contact pressure and increasing the number of points of engagement between the separable members reduces the resistance, it also means that the mechanism for moving the members between the open and closed positions must generate considerable force, thereby increasing the cost of the mechanism.

Prior art devices have included a plurality of spring-loaded contact fingers to provide a multiplicity of contact points upon each of which is exerted a spring force in a direction perpendiculr to the direction of relative movement between the separable members. While the contact resistance and therefore the temperature rise was within tolerable limits in such prior art devices, the resulting force required for actuation of the contacts required a costly high-energy actuating mechanism or was otherwise objectionable from a cost standpoint.

It is therefore desirable to provide a contact assembly exhibiting minimum contact resistance at a lower cost.

SUMMARY OF THE INVENTION

In accordance with the preferred embodiment of the present invention, there is provided a resilient sliding contact assembly comprising a housing, a contact member adapted for sliding electrical contact with an associated conductor, resilient biasing means acting upon the contact member, and means attached to the housing for loading the biasing means to produce a spring force along said contact member, the spring force having a line of action generally parallel to the direction of relative motion between the contact member and an associated conductor, thereby urging the contact member against the surface of the housing to produce electrical contact therebetween. The point of contact between the contact member and the housing surface is offset from the line of action of the spring force. The spring force is thus resolved into a component parallel to the direction of relative motion between the center conductor and the housing, and a component perpendicular to the direction of relative motion between the conductor and the housing.

DESCRIPTION OF THE PREFERRED EMBODIMENT

Figure 1:
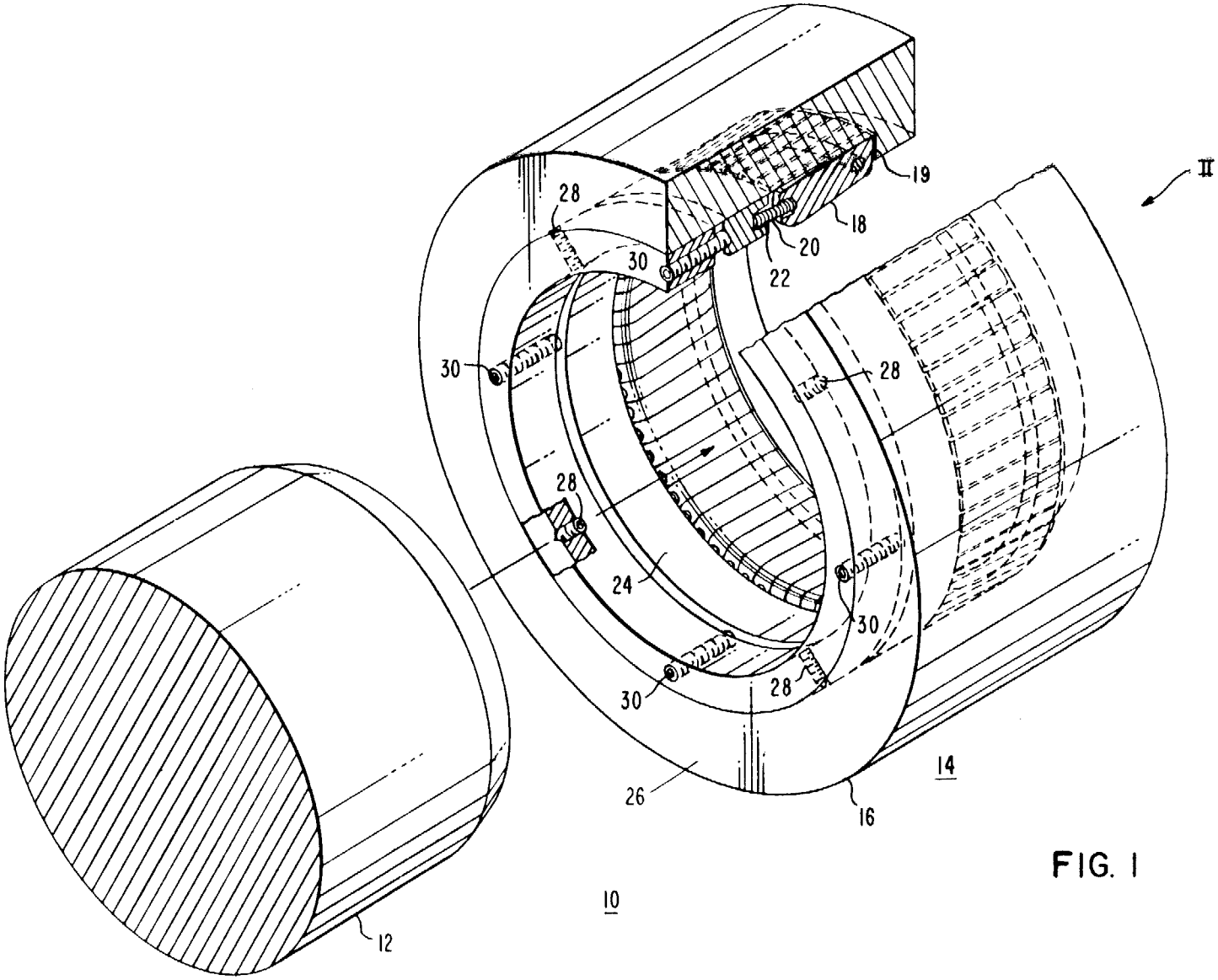
FIG. 1 is a perspective view of a telescoping contact assembly employing the principles of the present invention.

Throughout the drawings and specifications, like reference characters refer to corresponding components.

Referring now to FIG. 1, there is shown a telescoping contact assembly 10 incorporating the principles of the present invention. The assembly 10 includes a movable cylindrical center conductor 12 and a cooperating contact sheath assembly 14. When the conductor 12 is inserted into the assembly 14, the outer walls of the conductor 12 form electrical contact with a plurality of contact finger members 18 arranged around the inner circumference of the housing 16. The fingers 18 are held against a contact surface 19 by a plurality of coil springs 20, one of which is attached to each of the fingers 18. The other ends of the springs 20 are seated in a channel 22 of a metallic holder ring 24 and secured by a flexible adhesive.

A retainer ring 26 is seated around the inner circumference of the housing 16 (axially spaced from the fingers 18) and held there by set screws 28 engaging the inner surface of the housing 16. Loading screws 30 are threaded into the retainer ring 26 and are tightened against the holder ring 24 to load the springs 20 to provide the desired spring force upon the contact fingers 18.

Figure 2:
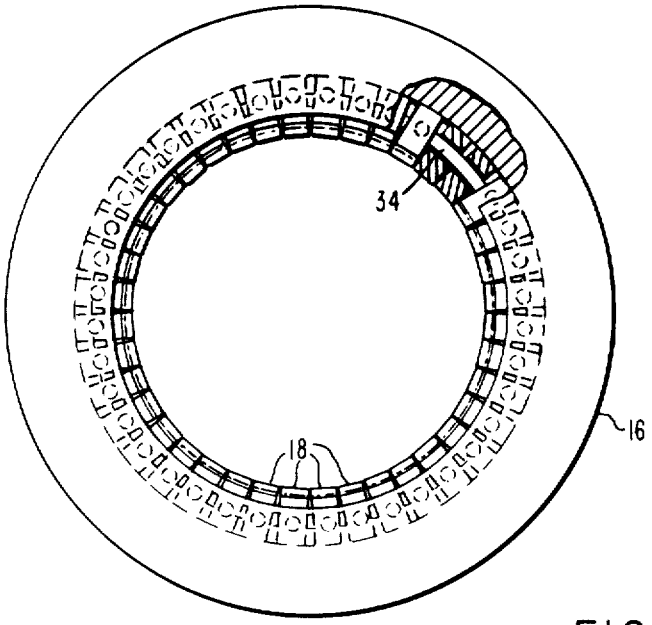
FIG. 2 is an end view of the contact sheath shown in FIG. 1.
Figure 3:
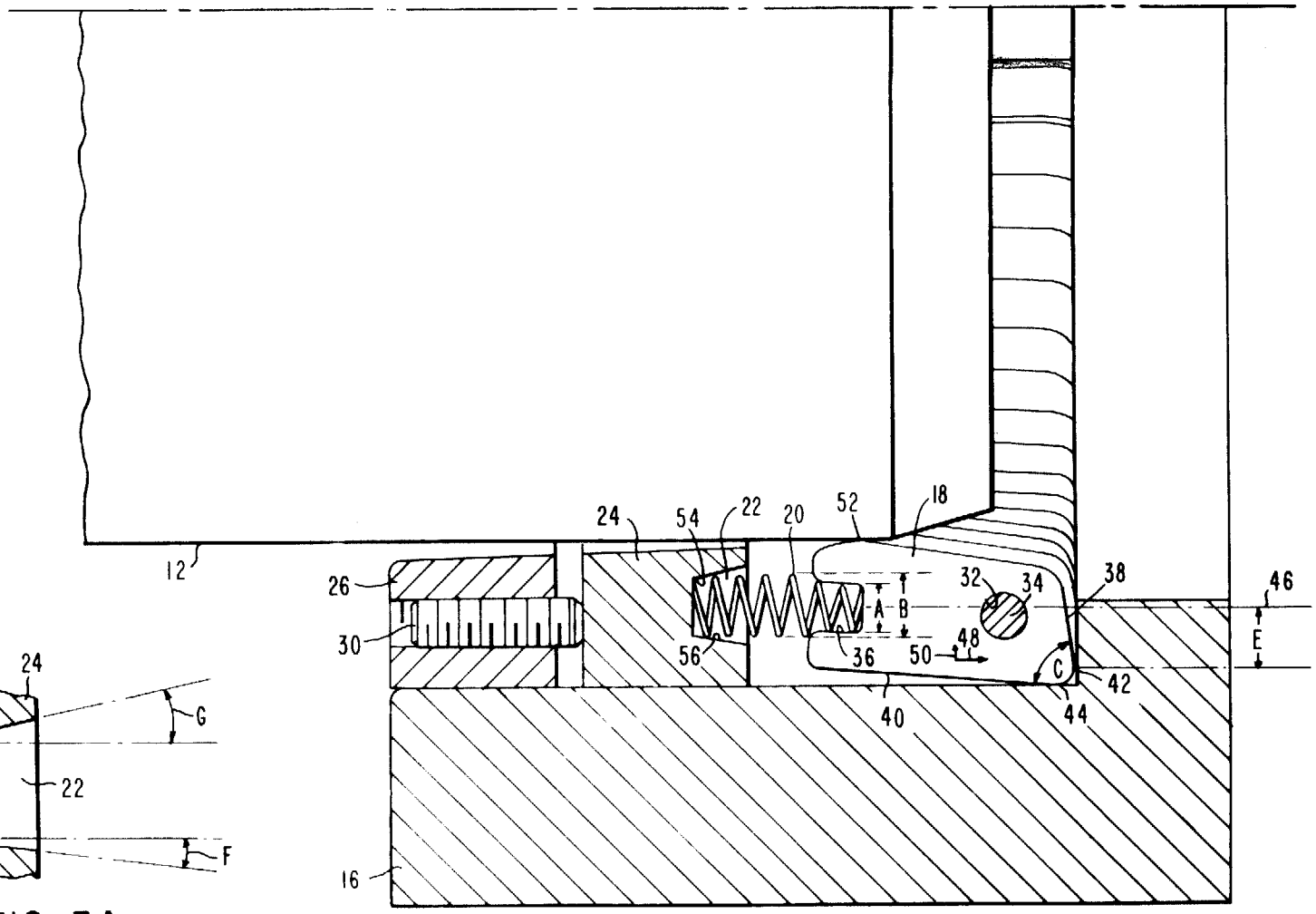
FIG. 3 is a partial sectional view of the contact assembly of FIGS. 1 and 2, showing the construction of the individual contact fingers.
Figure 3A:
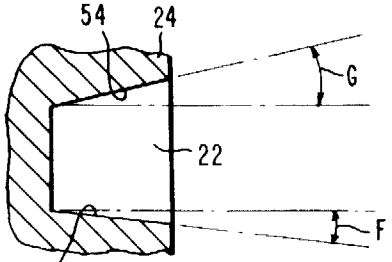
FIG. 3A is a partial sectional view of the spring seat.

As can be seen more readily in FIG. 3, each of the contact fingers 18 includes an aperture 32 through which extends a circular metallic stabilizer ring 34. The orientation of the stabilizer ring 34 can be seen more clearly in FIG. 2. During construction of the sheath assembly 14, the fingers 18 are strung upon the stabilizer ring 34 like beads upon a necklace. The ends of the stabilizer ring 34 are then crimped to slightly enlarge them and prevent the contact fingers 18 from sliding off. In addition to aiding in the assembly of the device, the stabilizer ring 34, by maintaining the contact fingers 18 in close proximity to each other, provides lateral stability and prevents the fingers 18 from sliding out of place during operation of the assembly 10.

As can be seen in FIG. 3, each of the springs 20 is seated in a notch 36, the height of which is indicated by dimension A of FIG. 3. The diameter of the spring 20 is greater than the dimension A as indicated by dimension B of FIG. 3. Thus, when the spring 20 is inserted from the side by an automated mechanical procedure (prior to stringing the fingers 18 on the ring 34), the spring 20 is compressed across its diameter and elongated in a direction perpendicular to the plane of the drawing. The spring 20 is thus securely retained by the notch 36 and will not fall out or come loose during either assembly or operation of the contact device.

Each of the contact fingers 18 as an end surface 38 and a bottom surface 40 which intersects an angle C less than 90°. The force of the spring 20 causes the contact finger 18 to bear against the housing 16 at the points 42 and 44. As can be seen the bearing point 42 is offset from the line of action 46 of the spring 20. This causes the force from the spring 20 to be resolved into a component 48 parallel to the direction of relative motion between the conductor 12 and the sheath assembly 14 and a force component 50 perpendicular to that direction. A contact pressure is thus maintained between the finger 18 and the housing 16 at the points 42 and 44, and another contact pressure at the point 52 between a protruding surface of the finger contact 18 and the center conductor 12. By adjusting the offset distance E between the spring force line of action and the engagement point 42, the relative contact pressures can be adjusted in any manner desired. For example, a contact assembly for a high voltage gas insulated disconnect switch having a center conductor diameter of 2.36 inches and a total of 56 contact fingers can provide contact pressures between the individual finger members 18 and housing 16 of about 10 pounds and a contact pressure between the center conductor 12 and contact finger 18 of about 3½ pounds. This contact assembly has a capability of handling 4,000 amperes continuous current and a symmetrical fault current of 63,000 amperes.

The walls 54 and 56 of the holder ring channel 22 are inclined at an angle to the axis of the spring 20. This provides two important advantages. First, the lower angle F aids in the assembly of the contact device. The upper angle G allows the spring 20 to buckle slightly when the center conductor 16 is disengaged, allowing the contact 18 to move upward. The inner diameter of the holding ring 24 is slightly larger than the outer diameter of the center conductor 12. Thus, proper engagement of the center conductor 12 and sheath assembly 14 is possible not only with a slight axial displacement therebetween, but also with a slight axial misalignment; that is, a degree of non-parallelism between the axes of the center conductor 12 and the sheath assembly 14. It is the inward movement of the finger contacts 18 permitted by the angled wall 54 of the channel 22 which permits such operation. For example, with angle G equal to 13°, the axes of the conductor 12 and sheath assembly 14 can be misaligned by as much as 3°. Proper operation under these conditions is especially important since axial misalignment is extremely difficult to correct, unlike axial displacement which can be more easily corrected by adjustment of components.

The use of contact fingers 18 having the disclosed configuration also produces a wiping action at the points 52, 42, and 44 during operation of the device 10. This is especially important when the device 10 is operated in an air environment which often tends to corrode exposed surfaces. Such corrosion occurring at the points of contact acts to raise the resistance and produce high running temperatures.

The individual contact fingers 18 can be formed by either a fine blanking process or a three-step process involving sintering, coining, and annealing to increase conductivity. The disclosed device allows the use of almost twice as many points of contact between the sheath assembly 14 and the center conductor 12 as would a device constructed for the same cost according to the prior art. Performance is thus substantially improved, allowing a reduced total contact pressure between the fingers 18 and the center conductor 12. This allows the use of less costly operating mechanism to provide motion for the center conductor 12.

Figure 4:
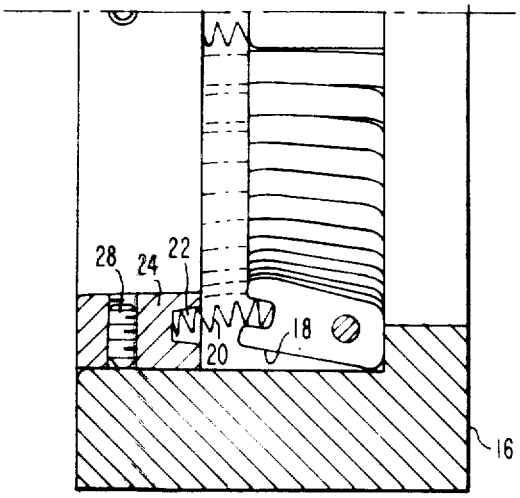
FIG. 4 is a partial sectional view similar to FIG. 3 of a telescoping contact employing an alternate embodiment of the present invention, with the center conductor withdrawn.

Various means of loading the springs 20 can be employed. For example, a unitary member 29 providing the functions of both the holder ring 24 and the retainer ring 26 is shown in FIG. 4. The spring seat channel 22 and set screws 28 are both included in the single member 29. Other means of loading the springs can also be employed.

The contact fingers could also be located on the outer circumference of the movable conductor 12 rather than on the inner circumference of the sheath assembly 14. While fewer fingers could be included for the same size contact, this configuration may be desirable in some applications.

It can be seen therefore that the present invention provides a high-current transfer contact assembly exhibiting significant advantages over the prior art at substantially reduced cost.

We claim:

1. A resilient sliding contact comprising:

a cylindrical housing;

a plurality of independently movable contact fingers circumferentially arranged in said housing and adapted for sliding electrical contact with an associated conductor, each of said fingers comprising an end surface and a bottom surface both physically contacting said housing with said end surface and said bottom surface intersecting an an angle less than ninety degrees;

a like number of springs each fixedly attached at one end to one of said contact fingers; and means connected to said housing for loading said springs to produce a bias force against each of said contact fingers, said bias forces each having a line of action generally parallel to the direction of relative motion between said contact fingers and an associated conductor and urging both of said contact finger end and bottom surfaces against corresponding surfaces of said housing to produce electrical contact therebetween, the point of contact between said finger end surface and said housing being offset from the line of action of said bias forces to produce contact pressure forces perpendicular to said lines of action.

2. A contact as recited in claim 1 wherein each of said fingers comprises a spring seat notch and each of said springs is press fitted into one of said notches.

3. A contact as recited in claim 1 wherein said perpendicular contact pressure forces urges said finger against said associated conductor.

4. A contact as recited in claim 1 wherein each of said fingers comprises an aperture therethrough and said contact comprises a stabilizer ring extending through all of said apertures.

5. A resilient sliding contact comprising:

a housing;

a plurality of independently movable contact fingers arranged in said housing and adapted for sliding electrical contact with an associated conductor, each of said fingers comprising an end surface and a bottom surface both physically contacting said housing with said end and bottom surfaces being configured such that said surfaces extend away from each other at an angle less than ninety degrees; and individual spring means each acting upon one of said contact fingers for producing bias forces against each of said contact fingers, said bias forces biasing said contact fingers against both said housing and said associated conductor.

6. A contact as recited in claim 5 wherein each of said fingers comprises an aperture therethrough and said contact comprises a stabilizer ring extending through all of said apertures.

7. A contact as recited in claim 5 wherein said individual spring means comprise a plurality of individual, independent springs.

8. A contact as recited in claim 7 wherein said springs are compression springs fixedly attached to each of said contact fingers.

9. A contact as recited in claim 7 including means connected to said housing for loading said springs to produce said bias forces.

* * * * *